US011950669B2

(12) United States Patent
Ernst et al.

(10) Patent No.: US 11,950,669 B2
(45) Date of Patent: Apr. 9, 2024

(54) TRAVEL CASE FOR JEWELRY

(71) Applicants: Christina Ernst, Eagle Creek, OR (US); Gregory R Ernst, Eagle Creek, OR (US); Andrew C Ernst, Sandy, OR (US)

(72) Inventors: Christina Ernst, Eagle Creek, OR (US); Gregory R Ernst, Eagle Creek, OR (US); Andrew C Ernst, Sandy, OR (US)

( * ) Notice: Subject to any disclaimer, the term of this patent is extended or adjusted under 35 U.S.C. 154(b) by 0 days.

(21) Appl. No.: 17/467,184

(22) Filed: Sep. 4, 2021

(65) Prior Publication Data

US 2022/0071361 A1 Mar. 10, 2022

Related U.S. Application Data

(60) Provisional application No. 63/074,959, filed on Sep. 4, 2020.

(51) Int. Cl.
*A45C 11/16* (2006.01)
*A45C 13/02* (2006.01)

(52) U.S. Cl.
CPC ..... *A45C 11/16* (2013.01); *A45C 13/02* (2013.01); *A45C 2013/026* (2013.01)

(58) Field of Classification Search
CPC ... A45C 11/16; A45C 13/02; A45C 2013/026; A45C 11/00; A45C 11/18; A45C 11/20; A45C 11/24; A45C 11/26; A45C 13/00; A45C 13/001; A45C 13/002; A45C 13/004; A45C 13/021; A45C 13/03; A45C 13/08; A45C 13/103; A45C 13/1038; A45C 13/1076; A45C 13/18; A45C 13/20; A45C 13/26; A45C 13/262; A45C 13/30; A45C 13/36; A45C 13/38; A45C 13/385; A45C 13/42; A45C 15/00; A45C 15/02; A45C 2005/037; A45C 2007/0004; A45C 2009/005; A45C 2011/002; A45C 2011/003; A45C 2011/007; A45C 2013/025; A45C 2013/1015; A45C 2200/05; A45C 2200/10; A45C 2200/15; A45C 3/00; A45C 3/004; A45C 3/06; A45C 5/03; A45C 5/04; A45C 5/045; A45C 5/06; A45C 5/14; A45C 5/146; A45C 7/00; A45C 7/0036; A45C 7/0054; A45C 7/0077; A45C 7/0095; A45C 9/00; B65D 5/38;

(Continued)

(56) References Cited

U.S. PATENT DOCUMENTS 268,454 A * 12/1882 Breidenstein ..... B65D 71/72 206/565
4,978,001 A * 12/1990 Nelson ..... A47B 46/00 248/222.52

(Continued)

FOREIGN PATENT DOCUMENTS

CN 109527753 A * 3/2019 ..... A45C 11/16
CN 212394132 U * 4/2020

*Primary Examiner* — Anthony D Stashick
*Assistant Examiner* — Marcos Javier Rodriguez Molina
(74) *Attorney, Agent, or Firm* — patenttm.us

(57) ABSTRACT

A jewelry case comprises separate earring and necklace holding portions, hingedly connected with a travel cover for storage and transport of jewelry, while allowing easy access to choose jewelry to wear. A separate ring storage portion includes a hinged door for access and storage of rings.

12 Claims, 11 Drawing Sheets

(58) Field of Classification Search

CPC .... B65D 5/728; B65D 85/1054; A44C 15/00; A44C 15/005; A44C 19/00; A44C 21/00; A44C 25/002; A44C 25/004; A44C 3/004; A44C 5/0015; A44C 9/0053; A44C 9/02; A45D 19/00; A45D 19/005; A45D 2200/1018; A45D 2200/1027; A45D 2200/1045; A45D 34/04; A45D 37/00; A45D 40/00; A45D 42/16; A45D 42/24; A45D 44/00; A45D 8/36; A45F 2003/003; A45F 2003/006; A45F 2003/142; A45F 2004/026; A45F 2005/006; A45F 2005/008; A45F 2200/05; A45F 2200/0516; A45F 2200/0525; A45F 2200/0566; A45F 3/02; A45F 3/04; A45F 3/14; A45F 3/46; A45F 4/00; A45F 4/02; A45F 4/12; A45F 5/00; A45F 5/02; A45F 5/021

USPC ..... 206/6.1, 0.8, 0.81, 0.82, 0.84, 1.5, 102, 206/103, 111, 127, 18, 19, 203, 205, 207, 206/209, 214, 215, 216, 217, 218, 223, 206/225, 228, 229, 232, 233, 235, 261, 206/266, 269, 278, 279, 284, 287, 287.1, 206/289, 290, 291, 292, 293, 294, 296, 206/297, 298, 301, 303, 305, 307, 307.1, 206/308.1, 308.2, 308.3, 310, 312, 313, 206/314, 315.1, 315.11, 315.2, 315.3, 206/315.4, 315.5, 315.6, 315.9, 316.1, 206/317, 320, 321, 326, 348, 349, 350, 206/352, 369, 37, 37.1, 37.8, 371, 372, 206/373, 376, 378, 38, 38.1, 386, 387.11, 206/387.15, 39, 395, 408, 418, 423, 425, 206/427, 428, 433, 438, 440, 443, 446, 206/449, 45.2, 45.23, 45.24, 45.25, 45.27, 206/45.28, 45.29, 45.3, 450, 455, 456, 206/457, 458, 459.1, 459.5, 461, 462, 206/463, 464, 466, 467, 469, 470, 471, 206/472, 473, 474, 475, 477, 478, 479, 206/480, 482, 483, 484, 484.2, 486, 487, 206/489, 490, 493, 494, 495, 497, 499, 206/503, 504, 507, 508, 509, 513, 514, 206/518, 521, 521.2, 522, 523, 524.2, 206/524.8, 525, 527, 528, 531, 538, 540, 206/549, 551, 554, 557, 558, 559, 560, 206/561, 562, 563, 564, 565, 566, 570, 206/572, 573, 574, 575, 576, 577, 578, 206/579, 581, 583, 587, 592, 63.5, 701, 206/702, 703, 705, 730, 731, 734, 735, 206/736, 737, 740, 742, 745, 747, 748, 206/749, 750, 751, 752, 754, 755, 756, 206/757, 758, 759, 760, 761, 762, 763, 206/765, 766, 767, 768, 769, 77.1, 770, 206/772, 774, 775, 776, 777, 779, 780, 8, 206/804, 805, 806, 807, 811, 813, 818, 206/819, 820, 823, 83, 831, 9; 63/1.11, 63/1.12, 1.13, 1.14, 1.15, 1.16, 1.18, 3, 63/3.1, 3.2, 4, 5.1, 9, 12, 13, 14.1, 14.4, 63/15, 15.1, 15.3, 18, 19, 20, 21, 23, 26, 63/27, 28, 29.1, 30, 31, 32, 33, 36, 38, 63/40, 206, 0.81, 0.82, 1.5, 6.1, 8, 37, 63/37.1, 37.8, 38.1, 45.2, 45.23, 45.24, 63/45.25, 45.28, 45.29, 63.5, 77.1, 83, 63/102, 111, 203, 205, 207, 209, 214, 63/215, 216, 217, 218, 223, 225, 228, 63/229, 232, 233, 235, 266, 269, 278, 63/287, 290, 292, 301, 303, 307, 307.1, 63/308.1, 308.2, 314, 315.11, 315.3, 63/315.4, 315.5, 315.6, 315.9, 316.1, 317, 63/320, 348, 349, 350, 352, 371, 372, 63/376, 378, 387.11, 387.15, 395, 418, 63/423, 427, 433, 438, 440, 443, 446, 63/449, 456, 457, 458, 459.1, 459.5, 461, 63/462, 463, 466, 467, 469, 470, 471, 63/472, 473, 475, 477, 478, 479, 480, 63/482, 483, 484, 484.2, 486, 487, 489, 63/490, 493, 495, 497, 499, 503, 504, 63/507, 508, 509, 514, 521, 521.2, 522, 63/523, 524.8, 525, 528, 531, 538, 540, 63/549, 551, 554, 557, 558, 559, 560, 63/561, 562, 563, 564, 565, 566, 570, 63/573, 574, 575, 576, 578, 579, 581, 63/583, 587, 592, 701, 703, 705, 731, 63/734, 736, 737, 740, 742, 745, 747, 63/748, 749, 750, 751, 752, 754, 755, 63/756, 757, 758, 759, 760, 762, 763, 63/765, 766, 768, 769, 772, 775, 776, 63/777, 779, 805, 806, 807, 811, 813, 63/818, 819, 823, 831, DIG. 2; 211/1.3, 211/4, 7, 10, 13.1, 14, 30, 38, 40, 41.12, 211/43, 49.1, 50, 57.1, 59.1, 59.2, 60.1, 211/70, 70.1, 72, 73, 74, 75, 85.2, 85.27, 211/85.3, 85.7, 87.01, 88.01, 89.01, 211/90.01, 96, 113, 118, 120, 122, 125, 211/126.15, 130.1, 134, 149, 163, 168, 211/169, 181.1, 183, 194, 196, 205; 220/4.21, 4.22, 4.23, 4.24, 4.26, 4.27, 220/4.29, 7, 8, 23.4, 23.83, 23.86, 23.87, 220/23.88, 23.89, 62.11, 62.14, 89.1, 200, 220/211, 212, 213, 230, 252, 256.1, 220/259.4, 260, 263, 264, 281, 315, 320, 220/323, 324, 326, 327, 328, 345.3, 220/345.4, 350, 376, 377, 378, 475, 476, 220/481, 483, 495.01, 495.06, 500, 506, 220/507, 509, 520, 521, 522, 523, 528, 220/529, 530, 532, 533, 553, 555, 571, 220/582, 586, 592.01, 592.2, 592.21, 630, 220/651, 660, 662, 665, 676, 694, 703, 220/735, 737, 738, 739, 740, 741, 742, 220/751, 755, 756, 763, 764, 768, 771, 220/787, 789, 796, 801, 810, 811, 812, 220/813, 815, 817, 818, 826, 827, 829, 220/832, 839, 843, 844, 845, 848, 908, 220/917, DIG. 26, DIG. 6; 224/160, 164, 224/165, 168, 175, 177, 180, 182, 191, 224/219, 220, 222, 235, 242, 245, 250, 224/257, 267, 269, 272, 404, 539, 576, 224/583, 587, 600, 604, 605, 612, 614, 224/617, 623, 637, 649, 652, 653, 658, 224/674, 901.6, 903, 920, 929, 930; 229/5.6, 5.81, 68.1, 87.02, 87.08, 92.8, 229/113, 116.1, 116.3, 116.5, 120.02, 229/120.28, 122, 122.33, 125, 125.11, 229/125.17, 125.21, 159, 164.1, 168, 174, 229/175, 186, 198.1, 199, 906.1, 922,

229/923; 428/36.9, 40.1, 42.1, 42.2, 42.3, 428/43, 80, 99, 343

See application file for complete search history.

(56) References Cited

U.S. PATENT DOCUMENTS

| | | | | |
|---|---|---|---|---|
| 6,161,686 | A * | 12/2000 | Simon | A45C 11/16 312/204 |
| 6,926,136 | B1 * | 8/2005 | Lynch-Bass | A47F 7/03 206/6.1 |
| 2015/0113846 | A1 * | 4/2015 | Nicholson | A45C 11/16 40/723 |
| 2020/0113301 | A1 * | 4/2020 | Nolan Krouse | A45C 13/1069 |

* cited by examiner

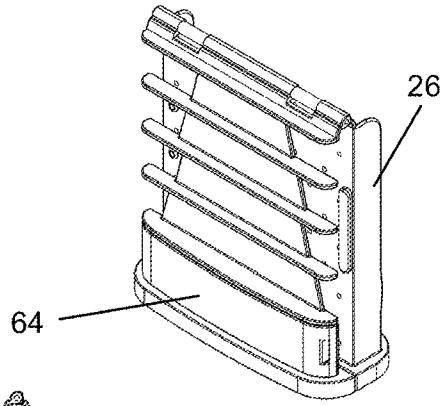
FIG. 1G
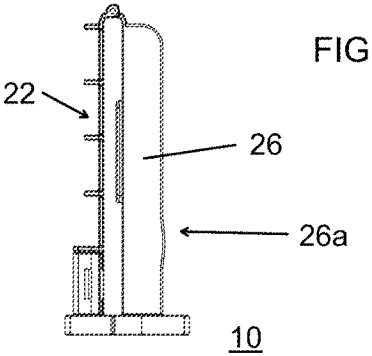
FIG. 1F
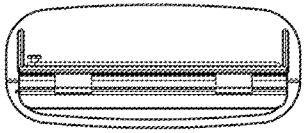
FIG. 1A
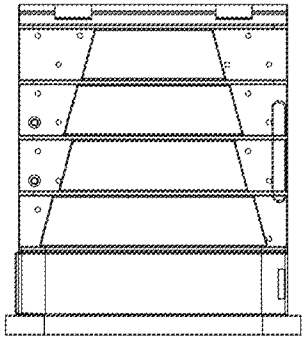
FIG. 1C
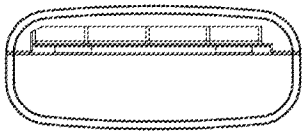
FIG. 1B
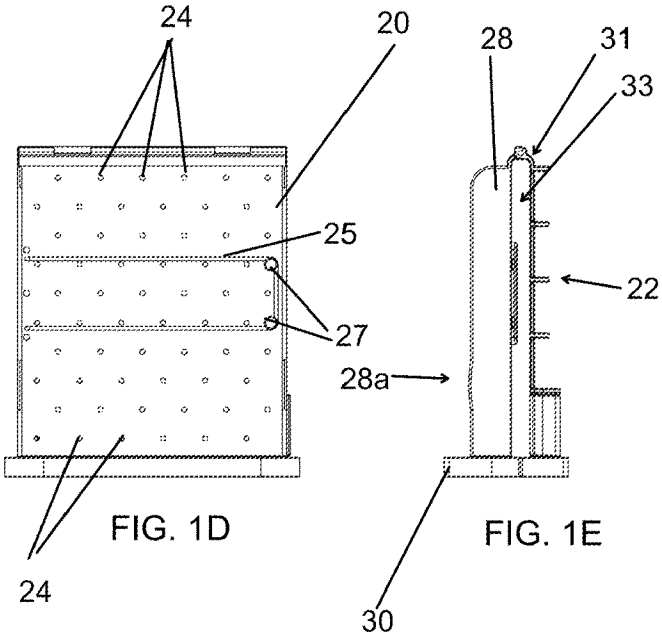
FIG. 1E
FIG. 1D

TRAVEL CASE FOR JEWELRY

CROSS-REFERENCE TO RELATED APPLICATIONS

This application claims benefit of U.S. provisional patent application SN 63074959, filed Sep. 4, 2020, titled TRAVEL CASE FOR JEWELRY, which is incorporated herein by reference.

BACKGROUND

This disclosure relates to traveling with jewelry, and more particularly for a travel case for carrying earrings and necklaces and rings.

When traveling, carrying earrings, necklaces, rings and other jewelry can be problematic, as necklace chains can become tangled and twisted when necklaces are stored in a bag or otherwise loosely assembled together, and when multiple necklaces are carried together in a suitcase or bag or other container, the necklace chains become tangled and intertwined with each other, and separating them can be difficult or frustrating. With earrings, particularly those designed for pierced ears, the hook ear wire portions from separate earrings can get tangled with one another, can snag or hook onto other items or clothing or can get tangled with necklace chains. The other items can tangle with rings also, where necklace chains wrap through the ring holes, for example. Also, if a number of earrings and/or necklaces and rings are put together in a bag, it can be a challenge to find a matching set out of a number of earrings and necklaces and rings with them all jumbled and tangled together.

SUMMARY

In accordance with the disclosure, a portable carrying case for earrings and necklaces is provided. A earring/necklace holder portion fits inside a cover member for easy transport and storage. The earring/necklace holder portion separates from the cover and has an earring receiving portion and a necklace receiving portion. The two portions are hingedly mounted so that the holder portion can be opened to provide a slanted standing presentation or alternatively an upright standing presentation. A separate ring compartment can store rings therein and close, to protect the rings and keep the rings in place.

The subject matter of the present technology is particularly pointed out and distinctly claimed in the concluding portion of this specification. However, both the organization and method of operation, together with further advantages and embodiments thereof, may best be understood by reference to the following description taken in connection with accompanying drawings wherein like reference characters refer to like elements.

BRIEF DESCRIPTION OF THE DRAWINGS

FIGS. 1A-G comprises top, bottom, front, rear, left, right and perspective views of a TRAVEL CASE FOR JEWELERY;

DETAILED DESCRIPTION

Figure 2G:
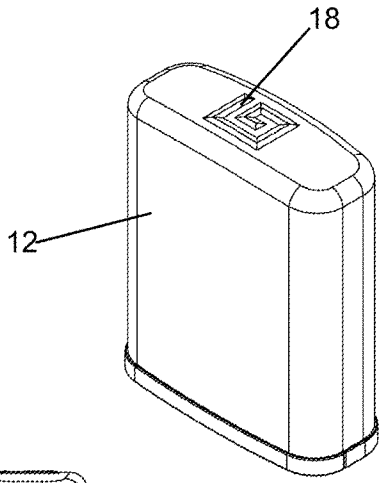
FIGS. 2A-G comprises top, bottom, front, rear, left, right and perspective views of a TRAVEL CASE FOR JEWELERY with cover attached.
Figure 2F:
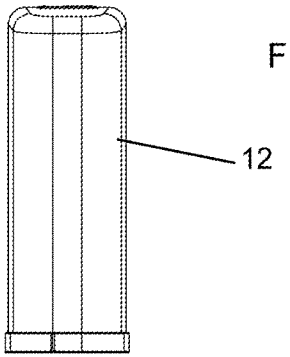
Figure 2A:
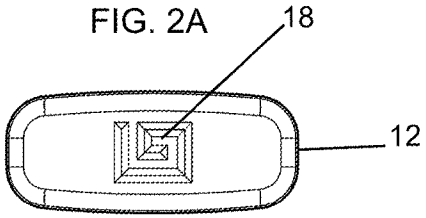
Figure 2C:
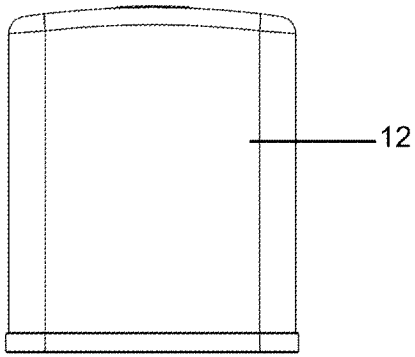
Figure 2B:
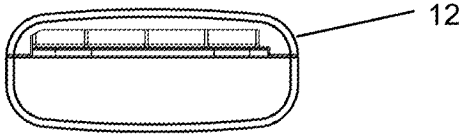
Figure 2E:
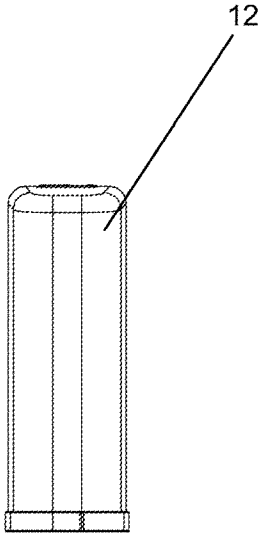
Figure 2D:
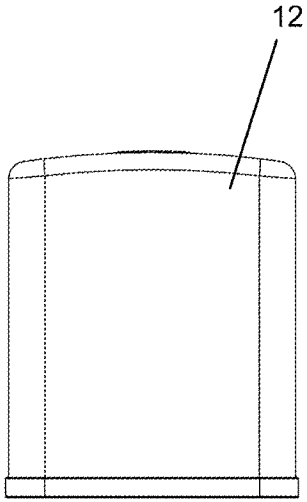

The system according to a preferred embodiment of the present disclosure comprises a convenient carrier for earrings and necklaces and rings that can be easily carried in a bag or suitcase, maintaining earrings and necklaces in an ordered fashion for ease of selection and use.

Referring to FIGS. 1A-1G, top, bottom, front, rear, left, right and perspective views of a TRAVEL CASE FOR JEWELERY, and FIGS. 2A-2G, corresponding to the views of FIGS. 1A-1G with a cover member installed, the device comprises a cover member 12 that is substantially hollow in its interior. The cover optionally has gripping members 14, 16 (grip 16 visible in FIG. 6, grip 14 on the rear side of the cover in a corresponding position to grip 16) near a top portion to allow a user to grasp the cover for removal. In the illustrated embodiment, the cover is of rectangular box-like configuration, with smoothed profile edges and corners. A brand or graphic 18 may be provided, such as at the top surface as illustrated, or on other surfaces of the cover.

Figure 3:
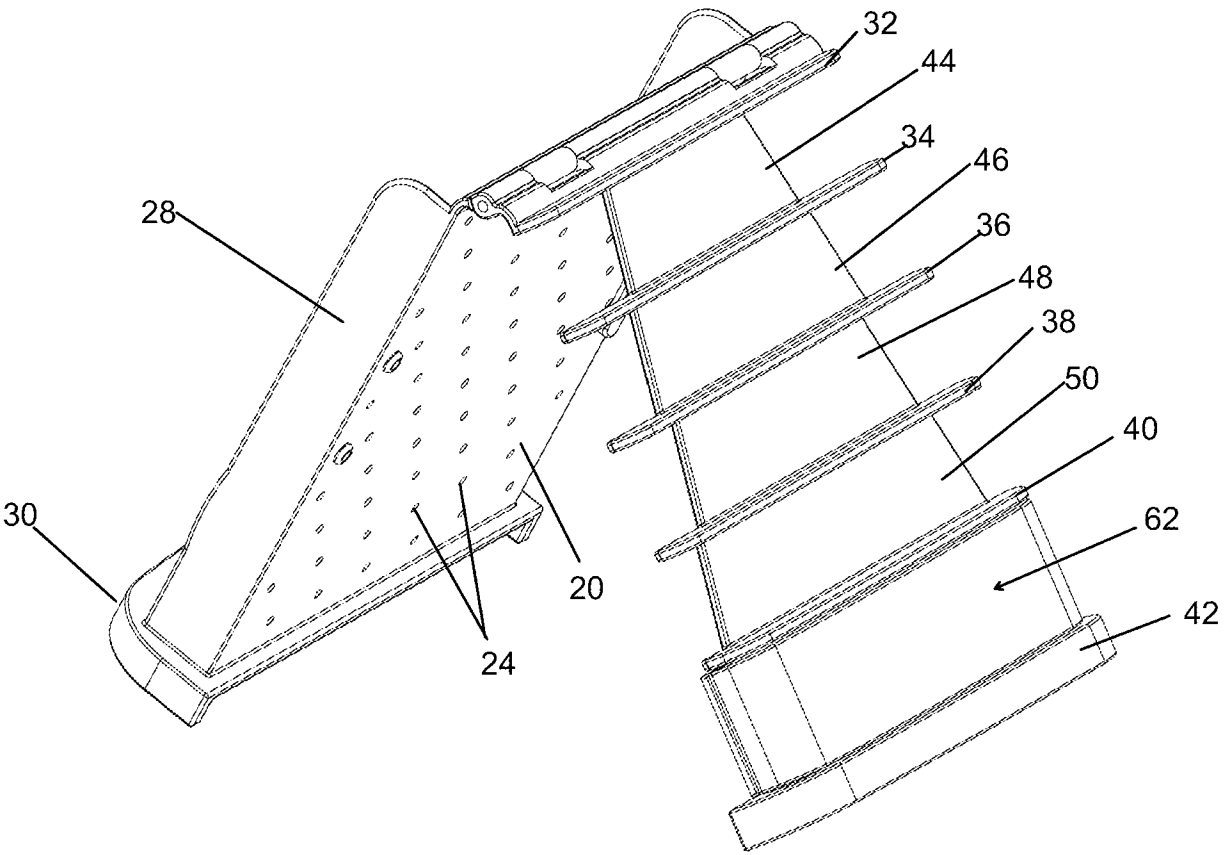
FIG. 3 is a perspective view of the TRAVEL CASE FOR JEWELERY illustrating the hinged open position relation between the earring and necklace holding portions.

FIG. 3 shows a perspective view of the inner portions of the TRAVEL CASE FOR EARRINGS AND NECKLACES, with the cover removed, wherein an earring receiving side 20 and a necklace receiving side 22 are provided. The earring receiving side 20 has multiple spaced holes 24 sized to receive the hook ear wire or stud portions of earrings therethrough, so as to allow the earrings to be held in defined positions. An elastic or other string/band member 25 may extend across several portions of the earring portion 20, supported by posts 27, to provide an engagement with the hook portion of hook earrings. Side members 26, 28 are defined on left and right edges of the earring receiving portion. At approximately the lower third of the side members 26, 28, a slightly raised portion 26*a*, 28*a* is defined. These raised profiles interact with the inner face of the cover member 12, to provide a frictional engagement to help secure the cover against unintended disengagement with the inner portions of the case, while still allowing easy removal of the cover. The bottom of the earring receiving side 20 defines an outwardly extending foot profile 30.

The necklace receiving side 22 has plural spaced shelf members 32, 34, 36, 38 and 40 extending most but not all of the width of bottom outwardly extending foot profile 42. Centrally of the necklace receiving side, defined between the shelf members are web portions 44, 46, 48, and 50, web portion 44 at the top of the necklace receiving side and being of the narrowest width, and web portions 46, 48, and 50 each being successively of larger width than the previous, such that the bottom most web portion 50 is of the greatest width, but less width than the bottom foot portion 42 width.

Defined between the bottom shelf member 40 and the foot portion 42 is a ring receiving portion 62 which has a hinged closable cover door 64 which may be swung open to define plural ring receiving bays 66, 68, 70 and 72. The bays each have a curved profile, as may be observed in FIGS. 4 and 5.

The upper portion of earring receiving side 20 has first and second hinge members 74, 76 positioned in spaced relation inwardly of the peripheral edges of the earring receiving side 20, while upper portion of necklace receiving side 22 has first, second and third hinge members 78, 80 and 82 positioned thereon, spaced apart to define openings 84, 86 and 88 in positions that allow hinge member 74, 76 of the earring side to fit into the openings 86, 88 when the earring side and necklace side are positioned back to back and the hinge portions 78 and 82 to fit on the outer sides of portions 74, 76, with the central hinge member 80 fitting into the space 84 between hinge members 74, 76. The hinge members comprise circular cross section shape with central bores 90 defined therein, such that a pin or pins can be inserted through the bores to secure the earring and necklace sides to one another, while allowing hinged movement of the two relative to each other. The connection of hinge portions 74 and 76 are connected to the upper portion of necklace receiving portion 22 via curved members 31, so as to define a space 33 between the inner faces of necklace receiving portion 22 and earring receiving side 20, for accommodating the necklaces therein when installed on the case, while still allowing the case to be put into a closed position.

Figure 6:
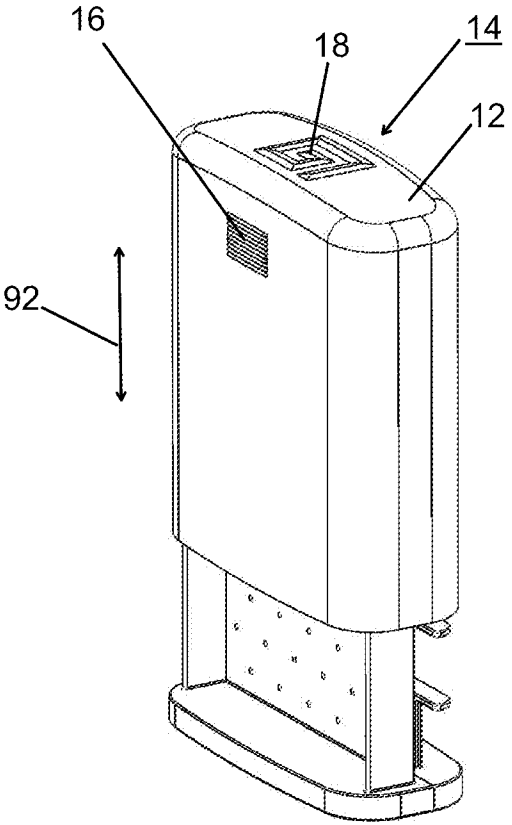
FIG. 6 is a perspective view of the travel case illustrating installation and removal of the cover.

When positioned as in FIG. 3, the earring and necklace side form a bottom profile with foot portions 30, 42, that corresponds to a somewhat larger profile than the profile of the opening of cover 12, with the outer profile dimensions of the cover being slightly less than the inner profile dimensions of the cover, such that upon positioning of the cover 12 over the earring/necklace side portions as in FIG. 6, the cover fits over the earring/necklace portions and a peripheral nm is provided by the foot portions. The cover interior interacts with portions 26*a* and 28*a* to provide a friction fit of the cover when closed. Moving the cover up and down in the direction of arrow 92 removes or applies the cover to allow access to the jewelry or to protect the jewelry for transport. Alternatively, or additionally, latching elements such as one or more detents/mating profiles may be provided to provide a locking fit together of the cover with the earring/necklace side portions.

Once the cover is on, it can be removed by grasping the cover and pulling it.

The door 64 may be opened to allow rings to be placed in the ring receiving bays, and then closed to keep the rings secure in place until later opened to allow access to the rings.

The varying widths of the web portions allows placement of necklaces of different lengths, wherein the necklaces may be wrapped around the web portions as needed.

Figure 4:
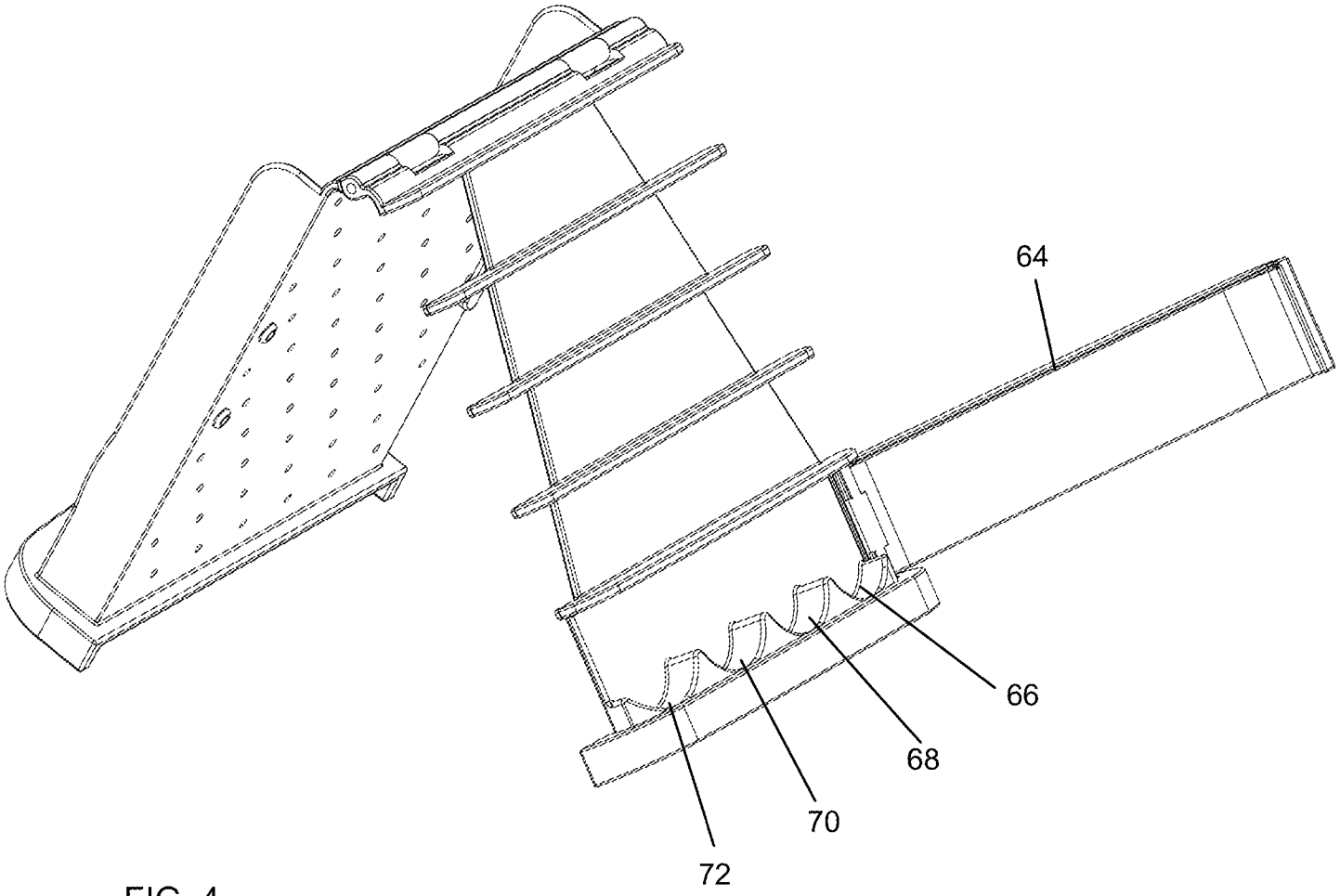
FIG. 4 is a perspective view of the TRAVEL CASE FOR JEWELERY in FIG. 3, with a ring door in an open position.
Figure 5:
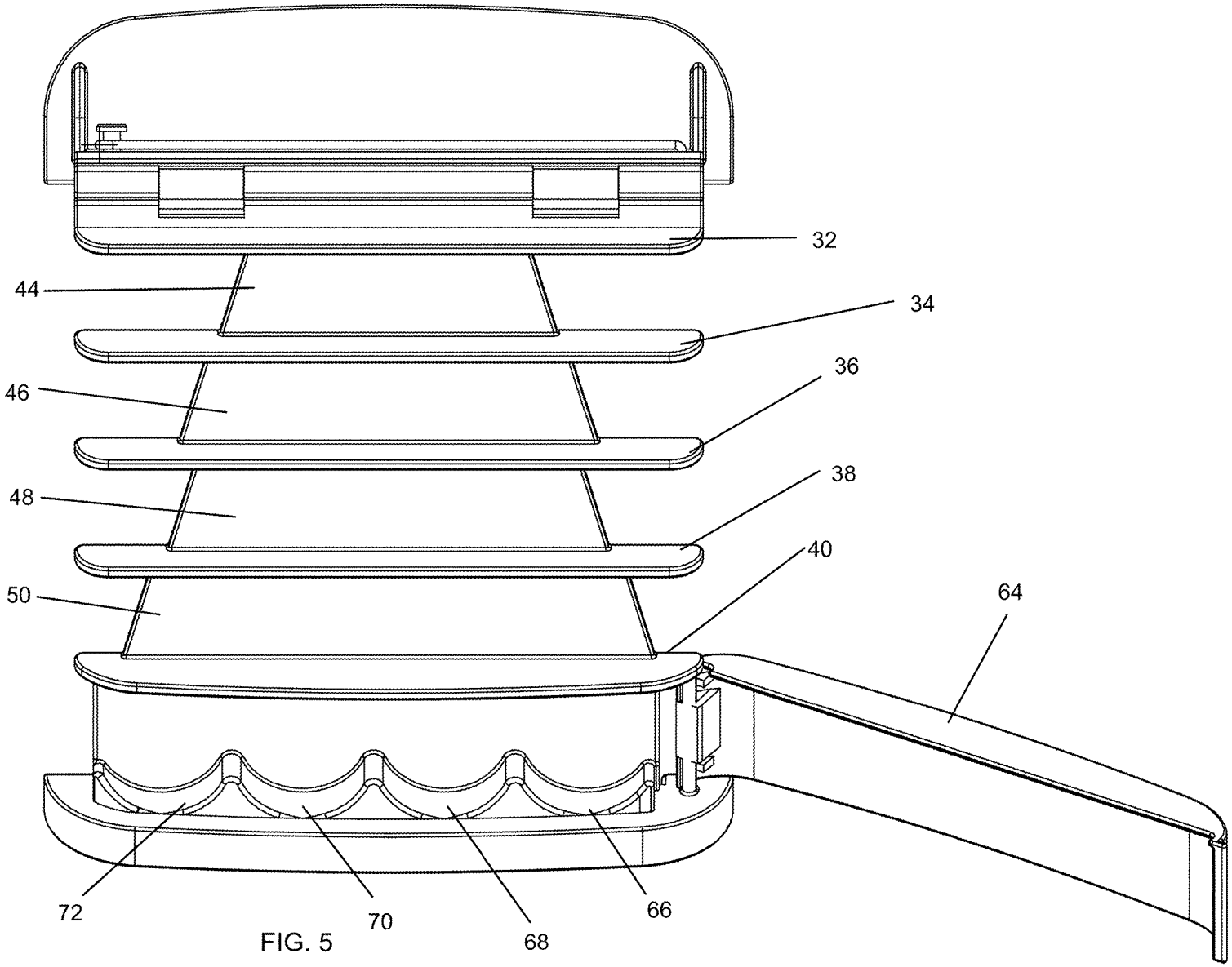
FIG. 5 is a top perspective view of the TRAVEL CASE FOR JEWELERY with the ring door open.
Figure 8:
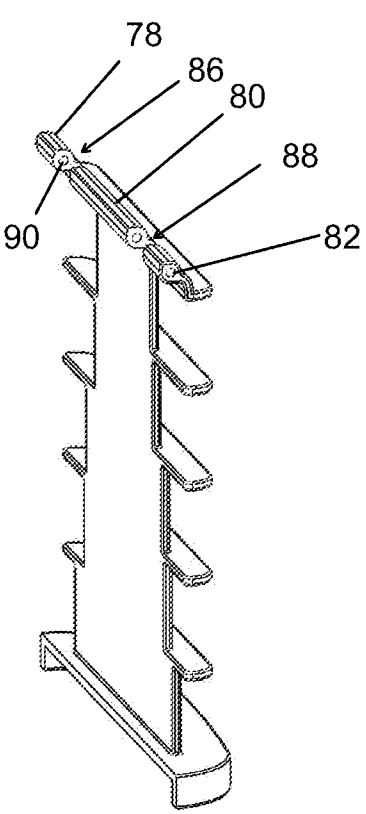
FIG. 8 a separate view of an necklace side portion of the case.
Figure 7:
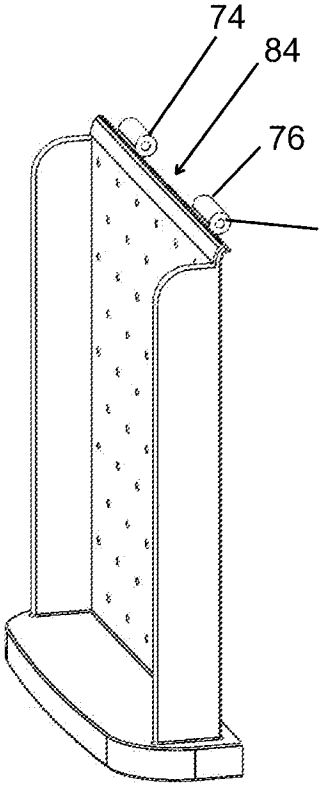
FIG. 7 is a separate view of an earring side portion of the case.

When choosing jewelry to wear from the holder, it may be positioned in the configuration of FIGS. 3 and 4, so it stands up on a dressing table, for example, allowing the user to observe and easily select desired jewelry pieces from the holder, or to put pieces into the holder for storage and transport. Once ready to move the jewelry, the necklace and earring portions may be be pushed back together to the configuration of FIG. 1G, the cover slid on as in FIG. 6, and the resulting configuration of FIG. 2G allows easy transport while protecting the jewelry from damage, loss or tangling/disorganization.

Figure 9A:
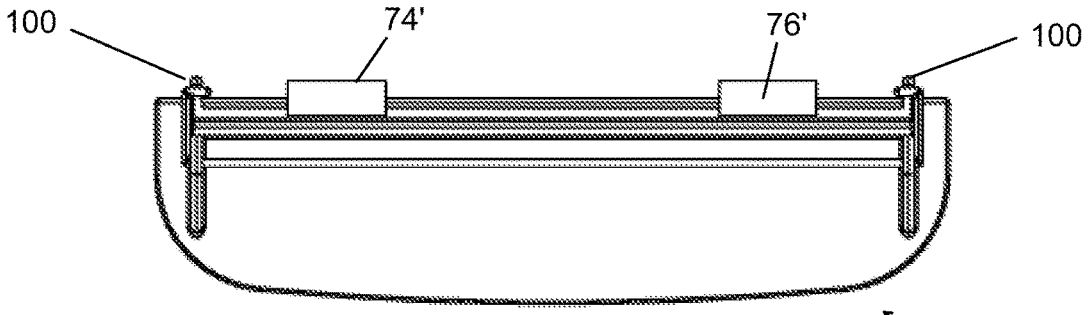
FIGS. 9A-G comprise top, bottom, front, rear, right, front upper perspective and rear upper perspective views of an alternative embodiment of the necklace receiving side of a TRAVEL CASE FOR JEWELERY.
Figure 9B:
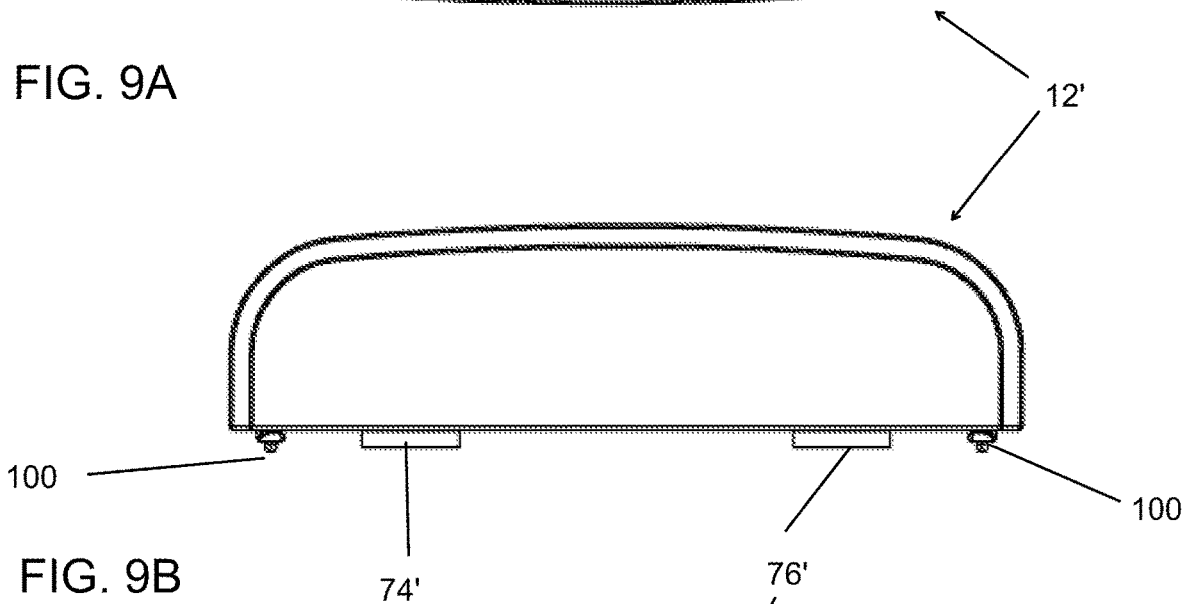
Figure 9C:
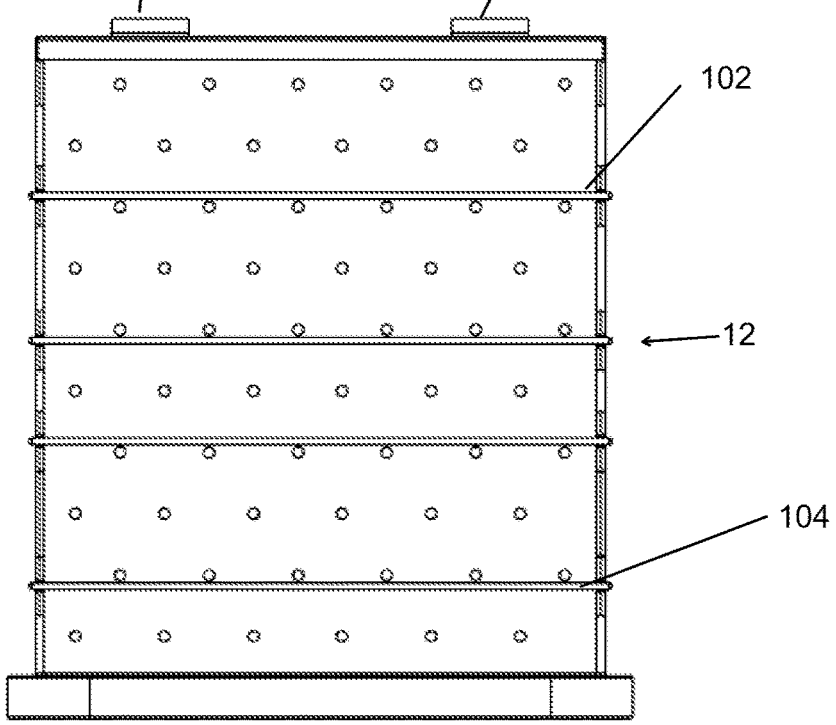
Figure 9D:
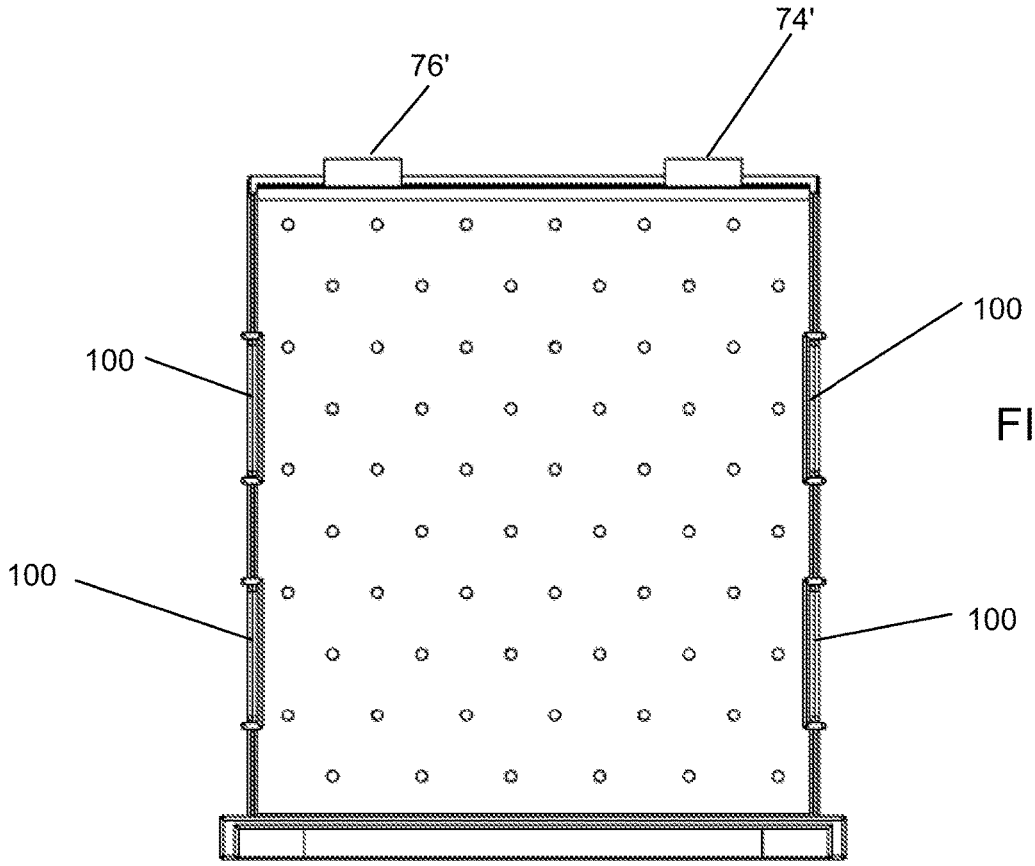
Figure 9E:
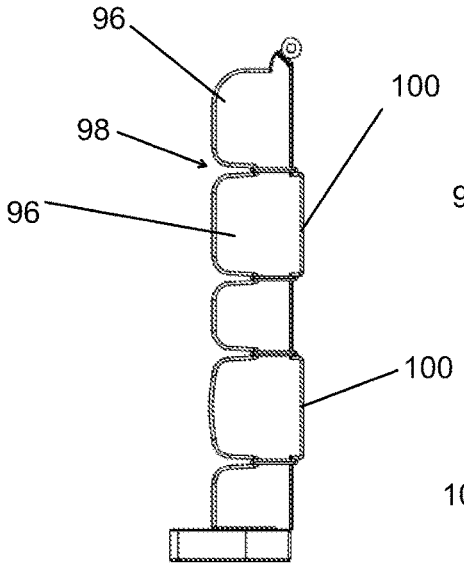
Figure 9F:
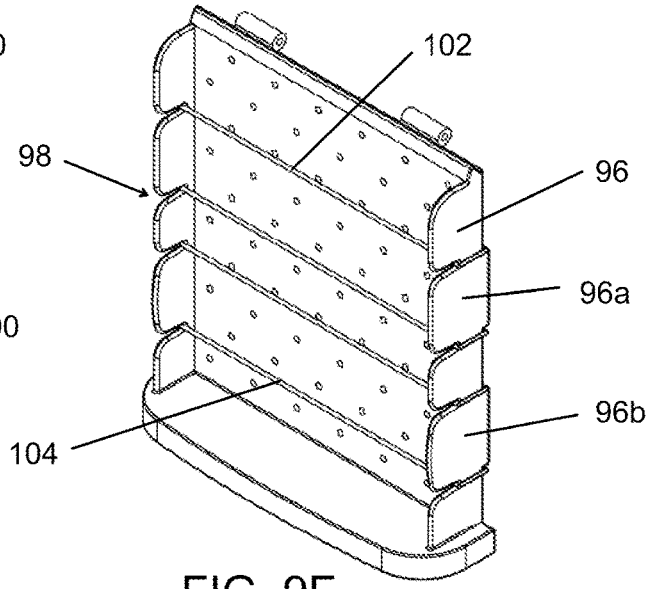
Figure 9G:
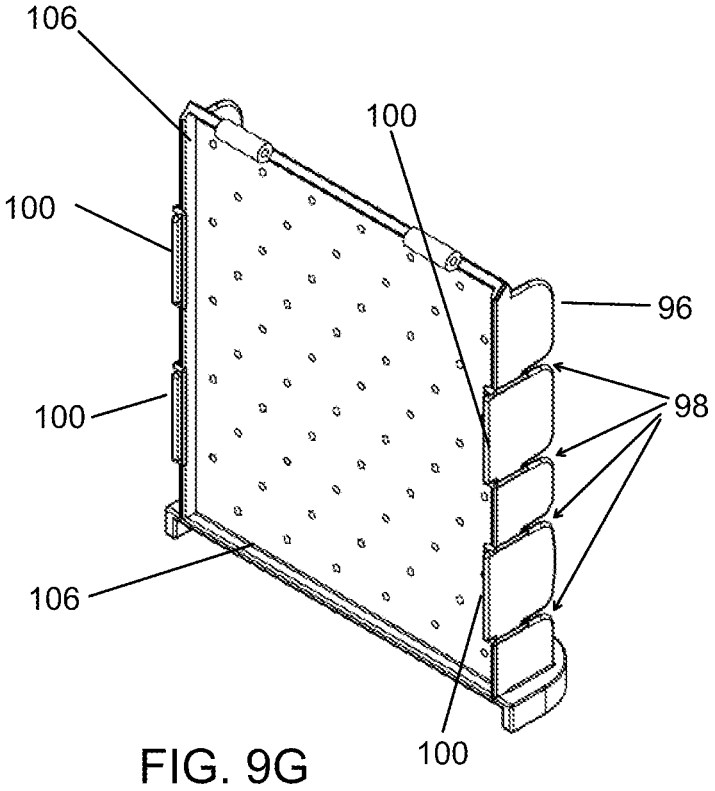

Referring to FIGS. 9A-G, which illustrate an alternative and preferred version of the earring receiving side of the device, earring receiving portion 12' comprises rib members 96 extending away from the planar body thereof at both left and right lateral edges of the body, with strap receiving slots 98 defined between adjacent ribs. The rear portion of two of the ribs 96*a* and 96*b* at each side of the body have strap engaging tab members 100 extending slightly rearwardly. This configuration allows stretch straps 102, 104 to be aligned with slots 98, and secured at the back by engagement with the tab members 100, to allow the straps to be used to secure earrings into engagement against the surface of the earring receiving portion 12, while enabling easy removal of the earrings when desired. The depth of the slots 98 defines the distance above the face of the earring receiving portion that the straps will sit, creating a desired offset of the straps relative to the face of the earring receiving portion. Referring to FIG. 9G, a rear perspective view of the earring receiving portion 12', a rib member 106 is defined at the back side edges of the portion 12', providing a raised profile forming a gap between the face of the portion 12 and the portion of the ribs that the straps engage, so that a user is able to easily grasp and unfasten the stretch straps as desired.

Figure 10A:
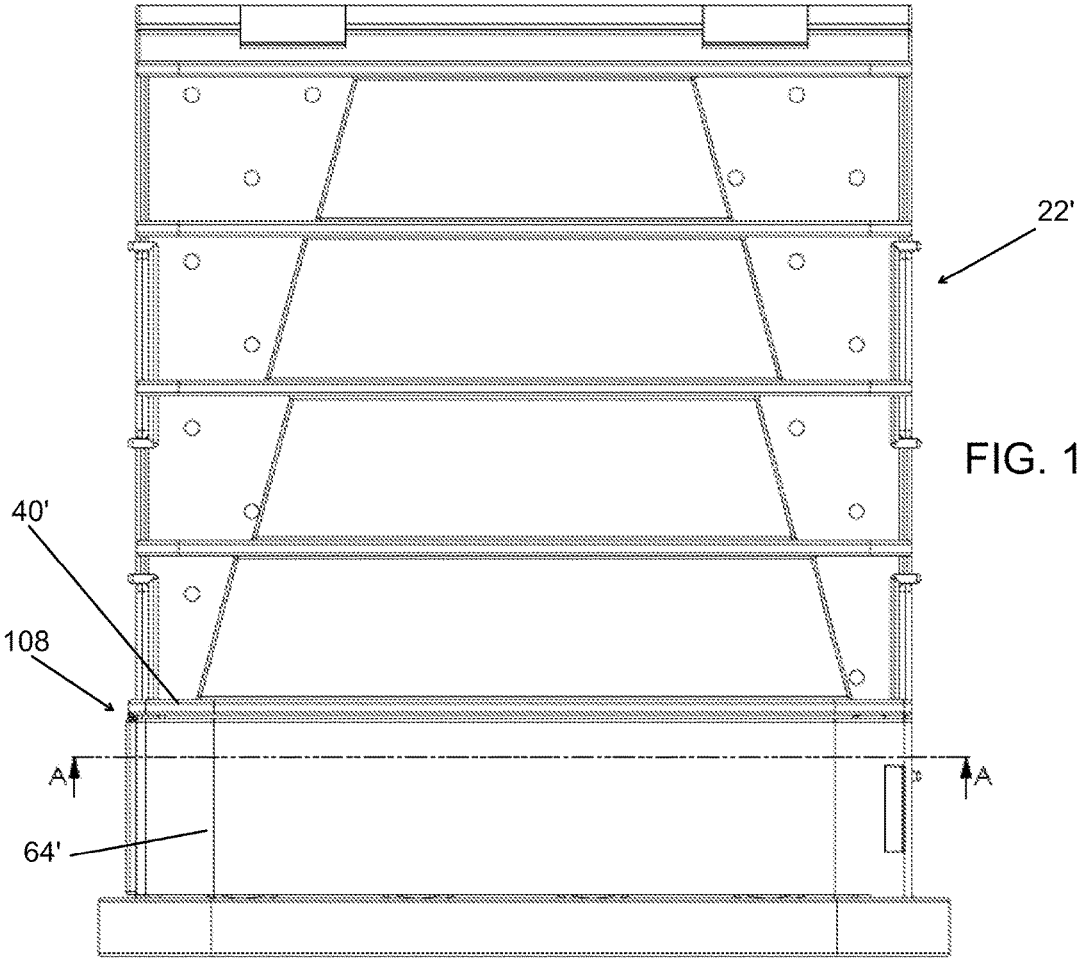
FIG. 10A is a front view from the necklace receiving side of a further embodiment of the case.
Figure 10B:
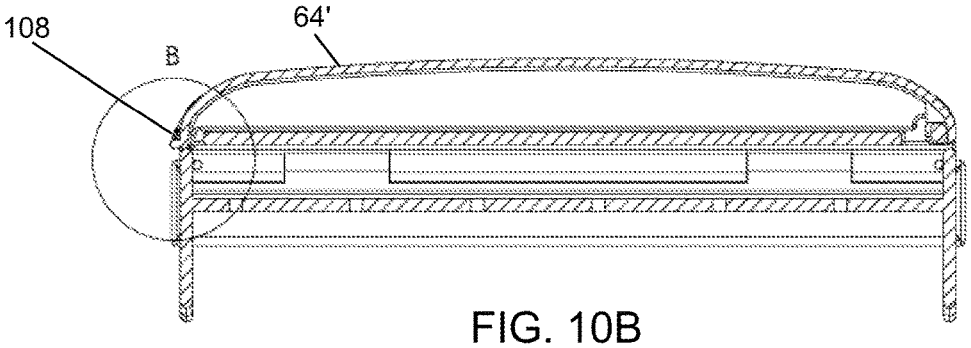
FIG. 10B is a sectional view of the case taken along line A-A of FIG. 10A.
Figure 10C:
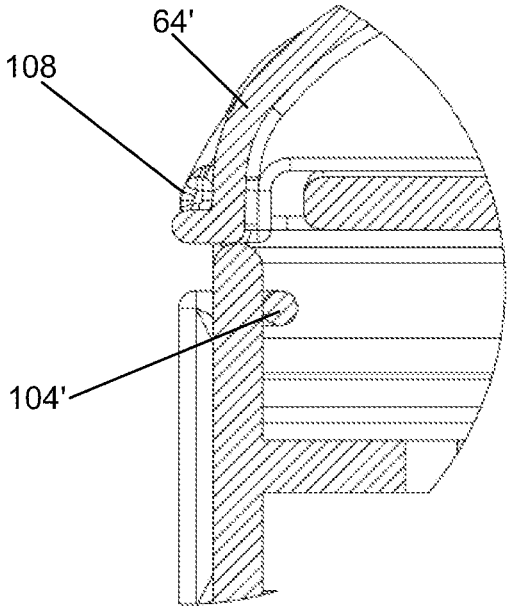
FIG. 10C is a detail view of FIG. 10B at circle B of FIG. 10B.
Figure 10D:
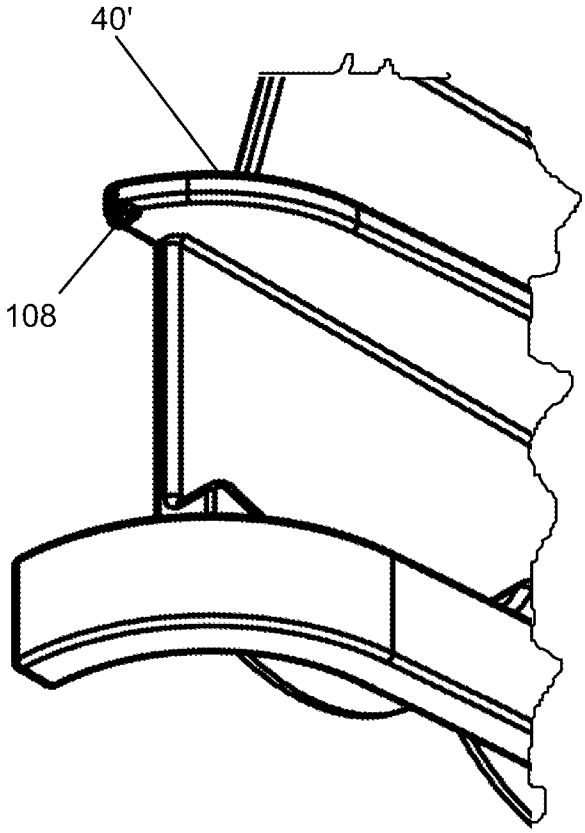
FIG. 10D is an enlarged partial perspective view of the detent area of the case.

Referring now to FIGS. 10A-10D, which illustrate a case employing an alternative version of the necklace receiving portion 22 of FIG. 1E and related drawings, alternative necklace receiving portion 22' includes a bump detent 108 provided at a bottom of shelf member 40', which engages with an upper edge of ring door 64', wherein a snap engagement between the detent bump and the door 64' when the door is closed will help to hold the door closed until a user desires to open the door, avoiding unintended opening of the ring door. FIG. 10D provides an enlarged view of the bump detent portion.

Thus an improved jewelry holder is provided, allowing earrings, necklaces and rings to be held in an organized manner for transport, such as in a purse or suitcase.

While a preferred embodiment of the technology has been shown and described, it will be apparent to those skilled in the art that many changes and modifications may be made without departing from the broader aspects. The appended claims are therefore intended to cover all such changes and modifications as fall within the true spirit and scope of the technology.

What is claimed is:

1. A jewelry case comprising:

an earring holding portion having a first earring portion plane;

a necklace holding portion having a first necklace portion plane;

a hinge member; and a removable cover member having an interior that is substantially hollow, for receiving said earring holding portion and said necklace holding portion therein, for providing protective cover for any jewelry placed in the earring holding portion or the necklace holding portion, wherein the earring and necklace holding portions are hingedly connected to one another via said hinge member and wherein said removable cover member slidingly receives said earring holding portion and said necklace holding portion into the interior portion of said removable cover member when said hinge member is in a closed position with said first earring portion plane and said first necklace portion plane moved to be substantially parallel to one another by operation of said hinge member.

2. The jewelry case according to claim 1, further comprising a ring holding portion having plural curved profile ring receiving bays.

3. The jewelry case according to claim 2, wherein the ring holding portion comprises a cover door that may be opened and closed.

4. The jewelry case according to claim 1, wherein the necklace holding portion comprises plural necklace receiving bays with central web portions, wherein the necklace receiving bays central web portions are of different widths.

5. The jewelry case according to claim 1, wherein the earring holding portion comprises plural receiving openings for receiving earring studs therein.

6. The jewelry case according to claim 1, wherein the earring holding portion comprises earring hook engaging member for securing earring hooks.

7. The jewelry case according to claim 1, wherein said earring holding portion further comprises strap receiving portions for removably mounting a securing strap for holding earrings against movement.

8. The jewelry case according to claim 3, wherein said cover door operates with said ring holding portion for providing an enclosed space for rings.

9. The jewelry case according to claim 8, further comprising a bump detent defined on a portion of said earring holding portion adapted to engage with said cover door to help maintain said cover door in place when in a closed position.

10. A jewelry case comprising:

an earring holding portion for removably mounting one or more earrings thereon;

wherein said earring holding portion includes securement strap mounting elements to allow a securement strap to be removably connected thereto for securing earrings thereto;

a necklace receiving portion for removably mounting one or more necklaces thereon;

wherein said necklace receiving portion comprises plural web members with dividers therebetween, wherein ones of said web members have differing widths for accommodating necklaces of differing lengths;

a ring receiving bay for storing rings therewithin, said ring receiving bay including a securement door for closing said ring receiving bay to secure rings stored therein from falling out of the bay, said ring receiving bay comprising plural curved ring receiving portions; and a cover member for receiving said earring holding portion, said necklace receiving portion and said ring receiving bay therewithin to secure the jewelry stored in the earring holding portion, the necklace receiving portion, or the ring receiving bay, wherein the earring and necklace holding portions are hingedly connected to one another via a hinge member and wherein said cover member receives said earring holding portion and said necklace holding portion and said ring receiving bay in the interior portion of said cover when said hinge member is in a closed position with a plane of said first earring portion and a plane of said first necklace portion moved to be substantially parallel to one another by operation of said hinge member.

11. The jewelry case according to claim 10, wherein said the hingedly connected earring and necklace holding portions provide open and closed positions, and when in the closed position, the said earring holding portion and said necklace receiving portion define a space therebetween to provide space to accommodate necklace portions and earring portions.

12. The jewelry case according to claim 10, further comprising a bump detent defined on a portion of said earring holding portion adapted to engage with said securement door to help maintain said securement door in place when in a closed position.

* * * * *